US009997864B2

(12) United States Patent
Hashimoto

(10) Patent No.: US 9,997,864 B2
(45) Date of Patent: Jun. 12, 2018

(54) ELECTRICAL CONNECTOR

(71) Applicant: DAI-ICHI SEIKO CO., LTD., Kyoto (JP)

(72) Inventor: Yoichi Hashimoto, Machida (JP)

(73) Assignee: DAI-ICHI SEIKO CO., LTD., Kyoto (JP)

( * ) Notice: Subject to any disclaimer, the term of this patent is extended or adjusted under 35 U.S.C. 154(b) by 0 days. days.

(21) Appl. No.: 15/687,569

(22) Filed: Aug. 28, 2017

(65) Prior Publication Data

US 2018/0069335 A1 Mar. 8, 2018

(30) Foreign Application Priority Data

Sep. 8, 2016 (JP) ..... 2016-175686

(51) Int. Cl.
*H01R 13/516* (2006.01)
*H01R 12/75* (2011.01)
(Continued)

(52) U.S. Cl.
CPC ..... *H01R 13/516* (2013.01); *H01R 12/712* (2013.01); *H01R 12/75* (2013.01);
(Continued)

(58) Field of Classification Search
CPC ..... H01R 13/6593; H01R 13/516
See application file for complete search history.

(56) References Cited

U.S. PATENT DOCUMENTS 5,358,428 A * 10/1994 Bixler ..... H01R 13/6581 439/406

5,409,400 A * 4/1995 Davis ..... H01R 24/60 439/607.48

(Continued)

FOREIGN PATENT DOCUMENTS

CN 103066406 B 10/2015
JP 2003-331997 A 11/2003

(Continued)

OTHER PUBLICATIONS

The extended European search report issued by the European Patent Office dated Nov. 3, 2017, which corresponds to European Patent Application No. 17184413.7-1801 and is related to U.S. Appl. No. 15/687,569.

(Continued)

*Primary Examiner* — James Harvey
(74) *Attorney, Agent, or Firm* — Studebaker & Brackett PC

(57) ABSTRACT

A plug connector includes: a ground contact conductor; an insulating housing; and a signal contact conductor. The ground contact conductor includes: a cylindrical main body having a slit that extends in an extending direction thereof; a pair of arms protruding from respective edges forming the slit of the main body in a radially outward direction of the main body; and fixing portions configured to fasten around the pair of arms from the exterior. Each fixing portion is provided with a protrusion protruding toward the corresponding arm and positioned at the center of the fixing portion in a protruding direction of the arms. In a state in which the arms are fastened with the fixing portions, the protrusions are in contact with the arms, and the arms and the fixing portions are separated from each other by the presence of the protrusions.

8 Claims, 13 Drawing Sheets

(51) Int. Cl.

| | |
|---|---|
| ***H01R 12/71*** | (2011.01) |
| ***H01R 43/048*** | (2006.01) |
| ***H01R 43/20*** | (2006.01) |
| ***H01R 13/6581*** | (2011.01) |
| ***H01R 13/405*** | (2006.01) |
| ***H01R 13/6593*** | (2011.01) |

(52) U.S. Cl.
CPC ..... *H01R 13/405* (2013.01); *H01R 13/6581* (2013.01); *H01R 13/6593* (2013.01); *H01R 43/048* (2013.01); *H01R 43/20* (2013.01)

(56) References Cited

U.S. PATENT DOCUMENTS

| | | | | |
|---|---|---|---|---|
| 6,234,840 | B1 * | 5/2001 | Nakata ..... | H01R 13/6593 439/607.01 |
| 2010/0081320 | A1 | 4/2010 | Maruyama et al. | |
| 2014/0038464 | A1 | 2/2014 | Tsai et al. | |
| 2014/0213107 | A1 | 7/2014 | Himi et al. | |

FOREIGN PATENT DOCUMENTS

| | | | |
|---|---|---|---|
| JP | 2012-109046 | A | 6/2012 |
| JP | 2012-243441 | A | 12/2012 |
| JP | 2013-222685 | A | 10/2013 |
| JP | 2015-106558 | A | 6/2015 |

OTHER PUBLICATIONS

An Office Action; "Notification of Reasons for Refusal," mailed by the Japanese Patent Office dated Apr. 3, 2018, which corresponds to Japanese Patent Application No. 2016-175686 and is related to U.S. Appl. No. 15/687,569; with English Translation.

* cited by examiner

ELECTRICAL CONNECTOR

CROSS-REFERENCE TO RELATED APPLICATIONS

This application is based upon and claims the benefit of priority from Japanese Patent Application No. 2016-175686, filed Sep. 8, 2016, the entire contents of which are incorporated herein by reference.

BACKGROUND

1. Field

The present disclosure relates to an electrical connector.

2. Disclosure of the Related Art

In general, a plurality of coaxial cables are wired inside a small device such as a mobile phone in order to transmit high-frequency signals between the circuit boards. A plug connector is provided at a tip of the coaxial cable. A receptacle connector is mounted on the circuit board. When the plug connector is fitted to the receptacle connector, the coaxial cable and the circuit board are electrically connected.

Japanese Unexamined Patent Publication No. 2013-222685 discloses an example of such a plug connector. The plug connector includes a conductive signal contact conductor, a conductive ground contact conductor, and an insulating housing made of an insulating material. An internal conductor of a coaxial cable is connected to the signal contact conductor. An external conductor of the coaxial cable is connected to the ground contact conductor. The insulating housing provides insulation between the signal contact conductor and the ground contact conductor. The insulating housing includes an insulating main body having a cylindrical shape and holding therein the signal contact conductor, and a protrusion protruding from the external circumference of the insulating main body in a radially outward direction of the insulating main body.

The ground contact conductor includes a cylindrical main body capable of housing the insulating main body of the insulating housing, a pair of arms protruding from a edge of the main body in a radially outward direction of the main body, a lid extending integrally from the edge of the main body in the cylinder-axis direction of the main body, and a pair of plate-like fixing portions extending from the lid. The protrusion of the insulating housing is interposed between the pair of arms. The pair of fixing portions serves to fix the lid onto the pair of arms by fastening around the pair of arms, as well as the protrusion, from the exterior. When the pair of fixing portions fastens around the pair of arms, the pair of fixing portions is brought into abutment against the pair of arms substantially entirely.

SUMMARY

An electrical connector according to one aspect of the present disclosure is an electrical connector configured to be fittable to a counterpart connector mounted on a circuit board. The electrical connector includes a conductive signal contact conductor to which an internal conductor of a coaxial cable is connected; a conductive ground contact conductor to which an external conductor of the coaxial cable is connected; and an insulating housing that insulates the signal contact conductor from the ground contact conductor. The ground contact conductor includes a cylindrical main body having a slit that extends in an extending direction thereof; a pair of arms protruding from respective edges forming the slit of the main body in a radially outward direction of the main body; and a fixing portion configured to fasten around the pair of arms from the exterior. At least one of the pair of arms and the fixing portion has a protrusion protruding toward the other. The protrusion is provided on the fixing portion at a position that is distant from an end near the main body in a protruding direction of the pair of arms. In a state in which the pair of arms is fastened with the fixing portion, the protrusion provided to at least one of the pair of arms and the fixing portion is in contact with the other, and the pair of arms and the fixing portion are separated from each other by the presence of the protrusion.

DETAILED DESCRIPTION

Figure 1:
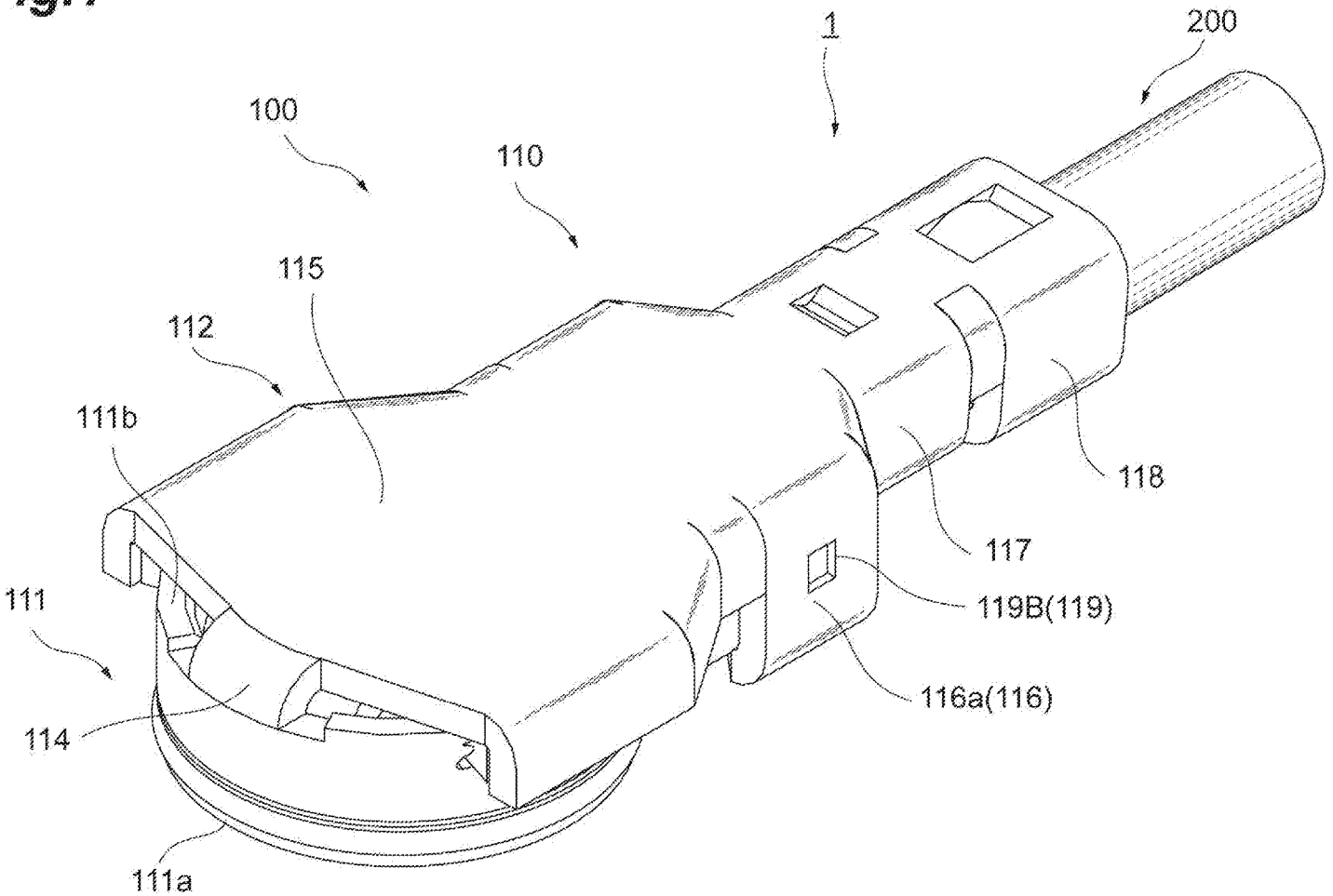
FIG. 1 is a perspective view of a connector assembly viewed from the top.
Figure 2:
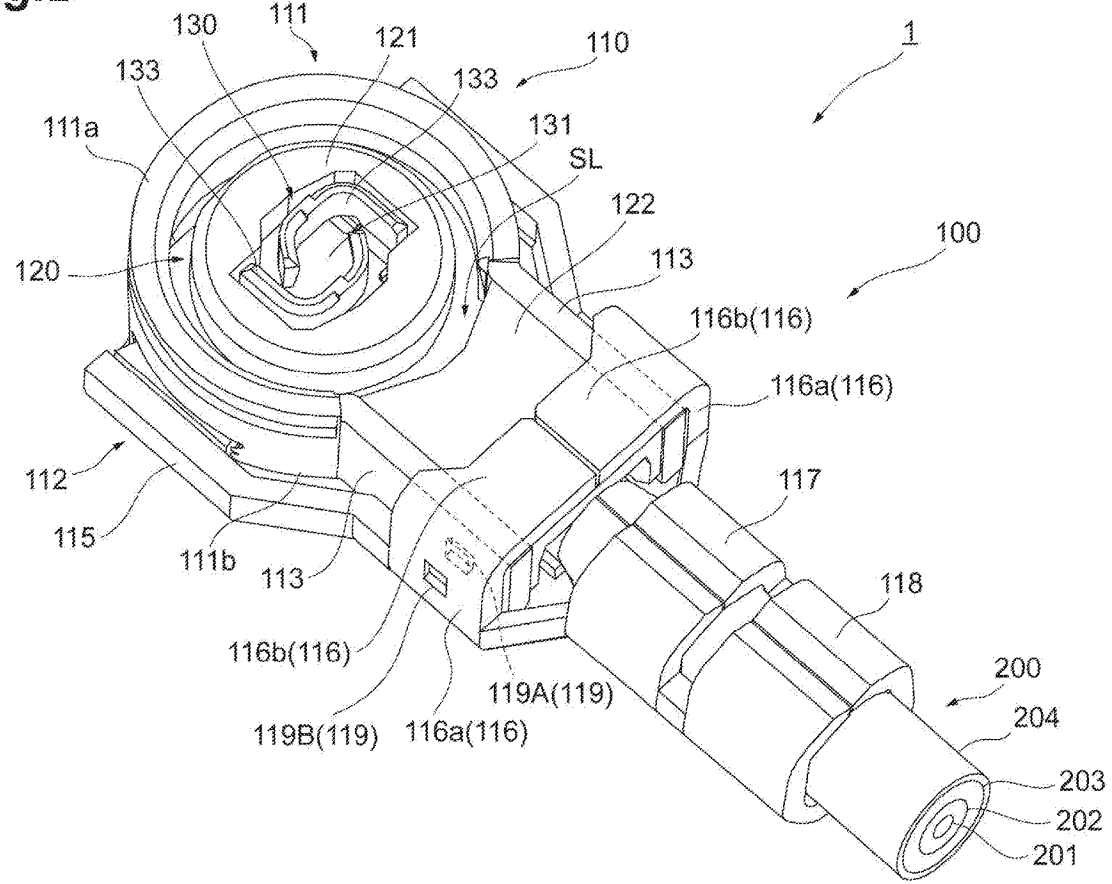
FIG. 2 is a perspective view of the connector assembly viewed from the bottom.
Figure 3:
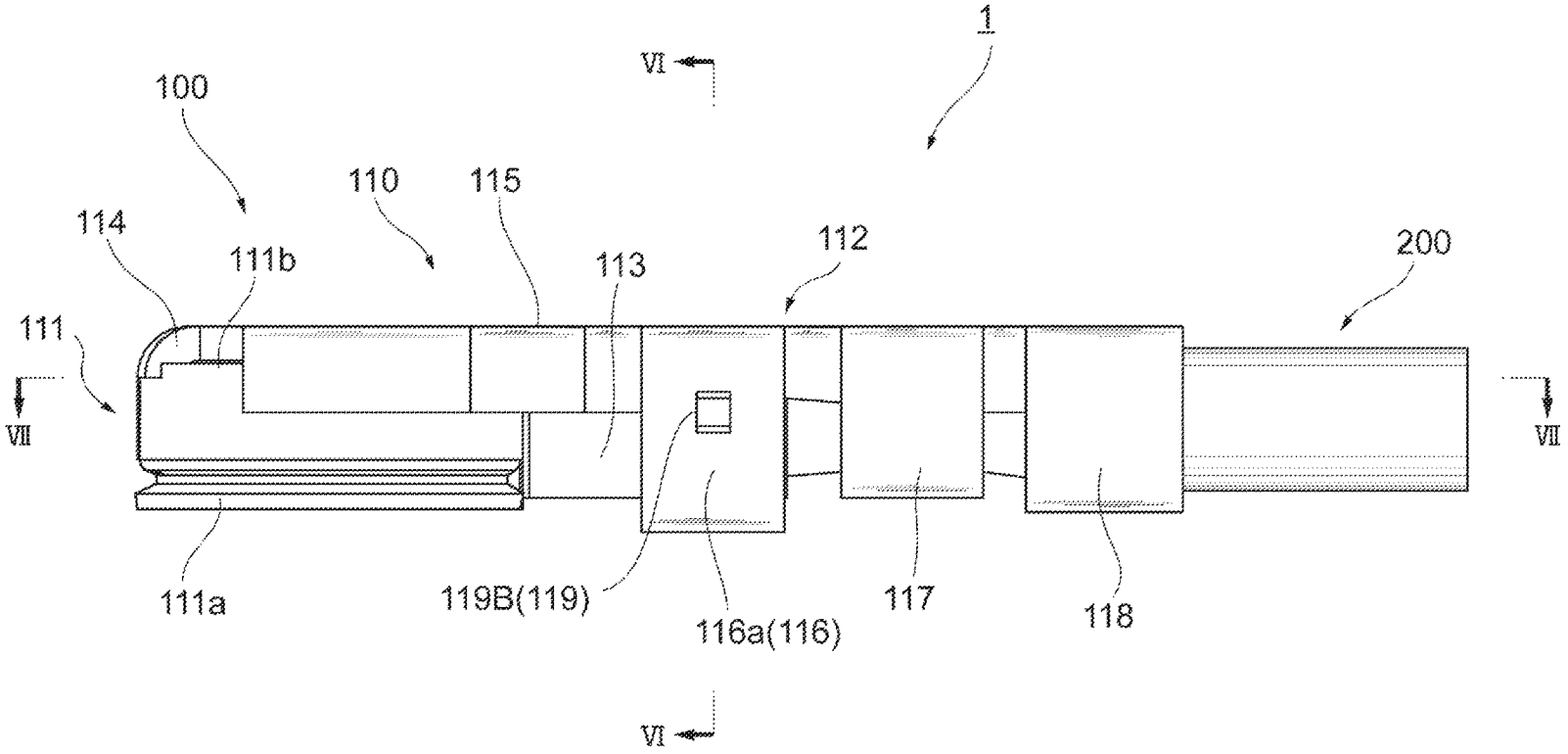
FIG. 3 is a side view of the connector assembly.
Figure 4:
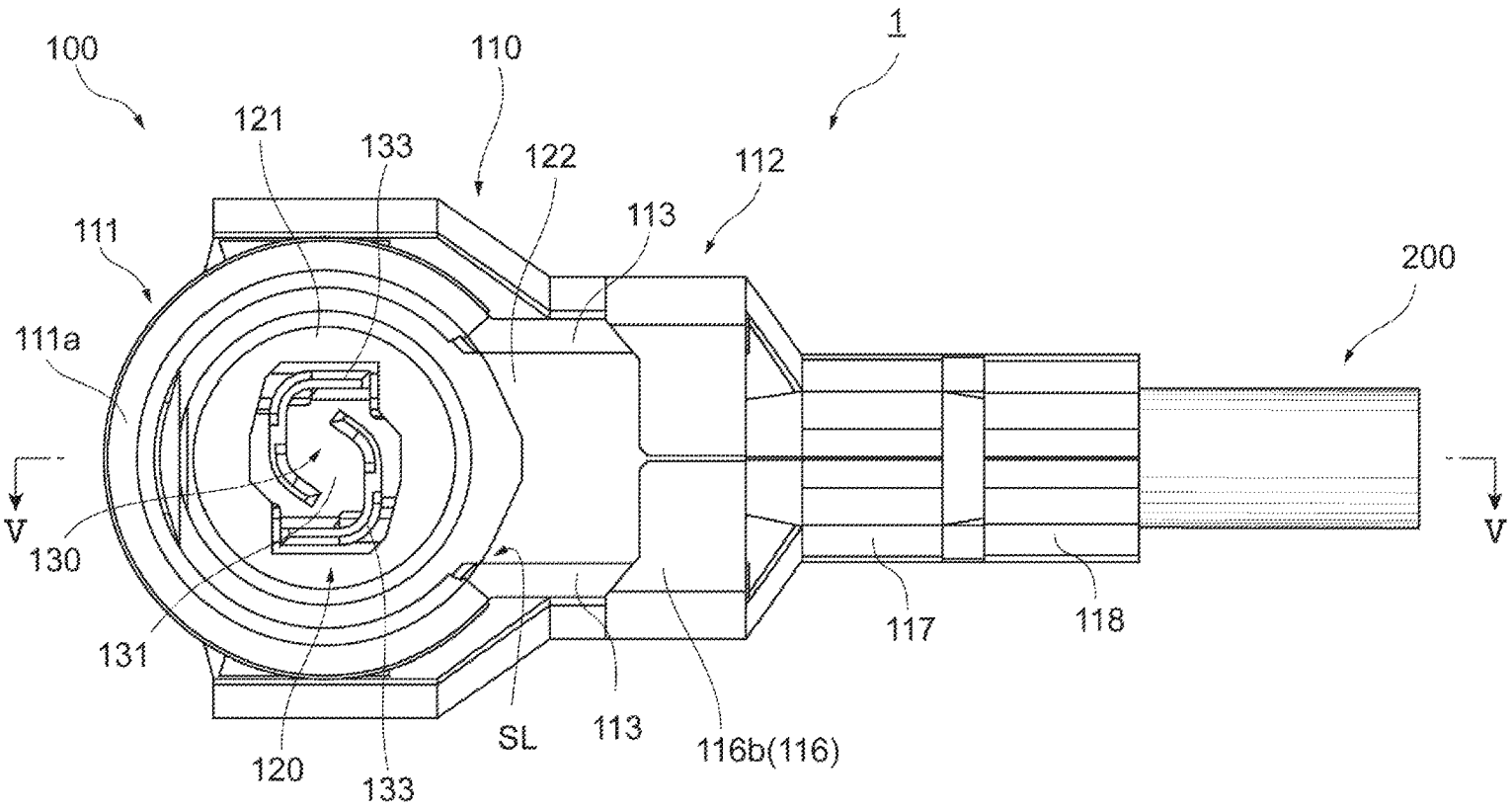
FIG. 4 is a bottom view of the connector assembly.

Embodiments according to the present disclosure described below are examples for explaining the present invention, and thus the present invention is not limited to the description below.

Outline of Embodiment

<1>An electrical connector according to one aspect of the present embodiment is an electrical connector configured to be fittable to a counterpart connector mounted on a circuit board. The electrical connector includes a conductive signal contact conductor to which an internal conductor of a coaxial cable is connected; a conductive ground contact conductor to which an external conductor of the coaxial cable is connected; and an insulating housing that insulates the signal contact conductor from the ground contact conductor. The ground contact conductor includes a cylindrical main body having a slit that extends in an extending direction thereof; a pair of arms protruding from respective edges forming the slit of the main body in a radially outward direction of the main body; and a fixing portion configured to fasten around the pair of arms from the exterior. At least one of the pair of arms and the fixing portion has a protrusion protruding toward the other. The protrusion is provided on the fixing portion at a position that is distant from an end near the main body in a protruding direction of the pair of arms. In a state in which the pair of arms is fastened with the fixing portion, the protrusion provided to at least one of the pair of arms and the fixing portion is in contact with the other, and the pair of arms and the fixing portion are separated from each other by the presence of the protrusion.

In the electrical connector according to the one aspect of the present embodiment, the protrusion is provided to at least one of the pair of arms and the fixing portion, and the protrusion protrudes toward the other. In a state in which the pair of arms is fastened with the fixing portion, the protrusion provided to at least one of the pair of arms and the fixing portion is in contact with the other, and the pair of arms and the fixing portion are separated from each other by the presence of the protrusion. Therefore, when the diameter of the main body is increased in the state in which the pair of arms is fastened with the fixing portion, a part of the pair of arms nearer to the main body of the ground contact conductor than the position of the protrusion becomes bent. Furthermore, in the electrical connector according to another aspect of the present embodiment, the protrusion is positioned on a side distant from the edge of the fixing portion in the protruding direction of the pair of arms. Therefore, the length of the deformable part of the pair of arms is increased, compared with the plug connector disclosed in Japanese Unexamined Patent Publication No. 2013-222685. Therefore, the pair of arms better serves as an elastic body, so that a better inserting/removing resistance against the counterpart connector can be ensured without reducing the width of the fixing portion or increasing the size of the plug connector. As a result, a better inserting/removing resistance against the counterpart connector can be achieved, while ensuring the rigidity and the size reduction.

<2> In the electrical connector according to the section <1> above, the protrusion provided to at least one of the pair of arms and the fixing portion may be positioned on a side distant from the center of the fixing portion in the protruding direction of the pair of arms. In this case, the length of the deformable part of the pair of arms is increased. Therefore, the pair of arms better serves as an elastic body, so that an even better inserting/removing resistance against the counterpart connector can be achieved.

<3> In the electrical connector according to the section <1> or <2> above, the insulating housing may include a cylindrical insulating main body configured to hold the signal contact conductor therein; and a protrusion protruding in the radially outward direction of the insulating main body from the peripheral surface of the insulating main body, the protrusion may be interposed between the pair of arms and be contact with the pair of arms. In this case, the pair of arms is backed up by the protrusion. Therefore, when the pair of arms, as well as the protrusion of the insulating housing, are fastened with the fixing portion, the force is applied more effectively on the pair of arms via the protrusion interposed between the fixing portion and the pair of arms. Thus, when the diameter of the main body is increased, the pair of arms is less displaced with respect to the protrusion, so that a sufficient inserting/removing resistance can be ensured, even when the plug connector is inserted into and removed from the counterpart connector a number of times.

<4> In the electrical connector according to any one of the sections <1> to <3> above, the ground contact conductor may further includes a lid extending from an edge of the main body on a side distant from the circuit board, and the fixing portion may be provided to the lid and may wind around the pair of arms to a point reaching an edge of the arms on the side facing the circuit board. In this case, the fixing portion can also serve to fix the lid onto the pair of arms, as well as to fasten the pair of arms.

Exemplification of Embodiment

The following describes one example of the embodiment according to the present disclosure in detail with reference to the drawings. In the following description, same elements or elements having same functions are designated by same numerals, and duplicate explanation is omitted.

[Connector Assembly]

As shown in FIG. 1 to FIG. 8, a connector assembly 1 is an article in which a plug connector 100 that is a type of electrical connector is connected to a tip portion of a coaxial cable 200. The plug connector 100 includes a ground contact conductor 110, an insulating housing 120, and a signal contact conductor 130. The plug connector 100 is configured to be fitted to or removed from a counterpart connector (for example, a receptacle connector) (not illustrated) mounted on a main surface of a circuit board (not illustrated) built into a small terminal such as a mobile phone.

When the plug connector 100 approaches the receptacle connector in a direction substantially orthogonal to the main surface of the circuit board, the plug connector 100 is fitted to the receptacle connector. On the other hand, when the plug connector 100 is separated from the receptacle connector in a direction substantially orthogonal to the main surface of the circuit board, the plug connector 100 is removed from the receptacle connector. Hereinafter, in this specification, a direction (an insertion direction) in which the plug connector 100 is fitted to the receptacle connector, that is, the direction in which the plug connector 100 approaches the circuit board will be referred to as a "downward direction". Hereinafter, in this specification, a direction in which the plug connector 100 is removed from the receptacle connector, that is, the direction in which the plug connector 100 is moved away from the circuit board will be referred to as an "upward direction".

[Coaxial Cable]

The coaxial cable 200 is a wire that is used in a small terminal, such as a mobile phone in order to transmit high-frequency signals between various circuit boards built into the small terminal, for example. As illustrated in FIGS. 2 and 5 to 8, the coaxial cable 200 includes an internal conductor 201, an insulator 202, an external conductor 203, and a protection sheath 204.

The internal conductor 201 is a metal wire (such as a copper wire) extending linearly. The internal conductor 201 may be formed of one metal wire or a braided net wire in which a plurality of fine metal wires are knitted. The internal conductor 201 functions as a signal line through which electric signals such as high-frequency signals are transmitted. The insulator 202 has a tubular shape and is made of an insulating material (such as polyethylene). The internal conductor 201 is inserted into the tubular insulator 202. Therefore, the insulator 202 covers a peripheral surface of the internal conductor 201.

The external conductor 203 has a tubular shape and is formed of a braided net wire (a mesh or spiral shape) in which a plurality of fine metal wires (such as fine copper wires) are knitted. The insulator 202 is inserted into the tubular external conductor 203. Therefore, the external conductor 203 covers a peripheral surface of the insulator 202 and is insulated from the internal conductor 201 by the insulator 202. The external conductor 203 functions as a ground (GND). The protection sheath 204 has a tubular shape and is made of an insulating material (such as polyethylene, polyvinyl chloride or the like). The external conductor 203 is inserted into the tubular protection sheath 204. Therefore, the protection sheath 204 covers the peripheral surface of the external conductor 203 and protects the external conductor 203 from being electrically connected to any other conductor.

Figure 5:
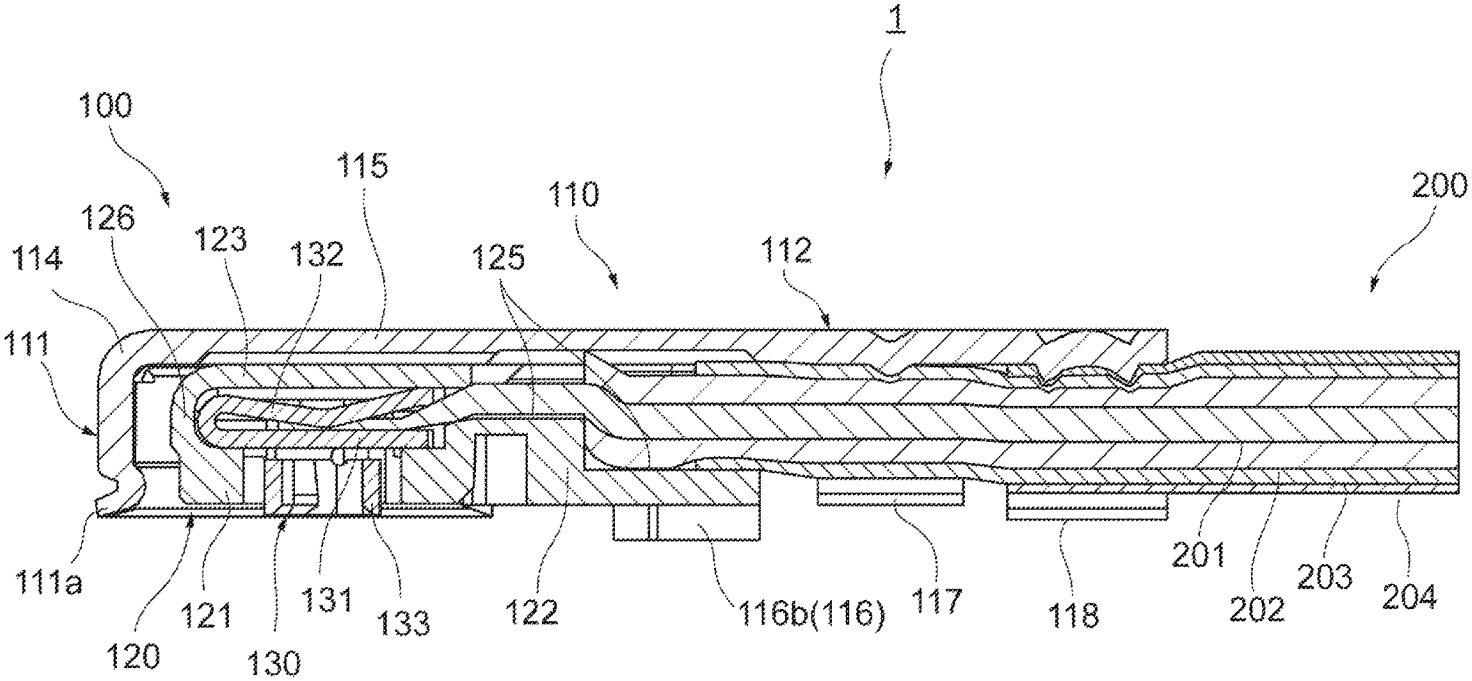
FIG. 5 is a cross-sectional view across the line V-V in FIG. 4.
Figure 6:
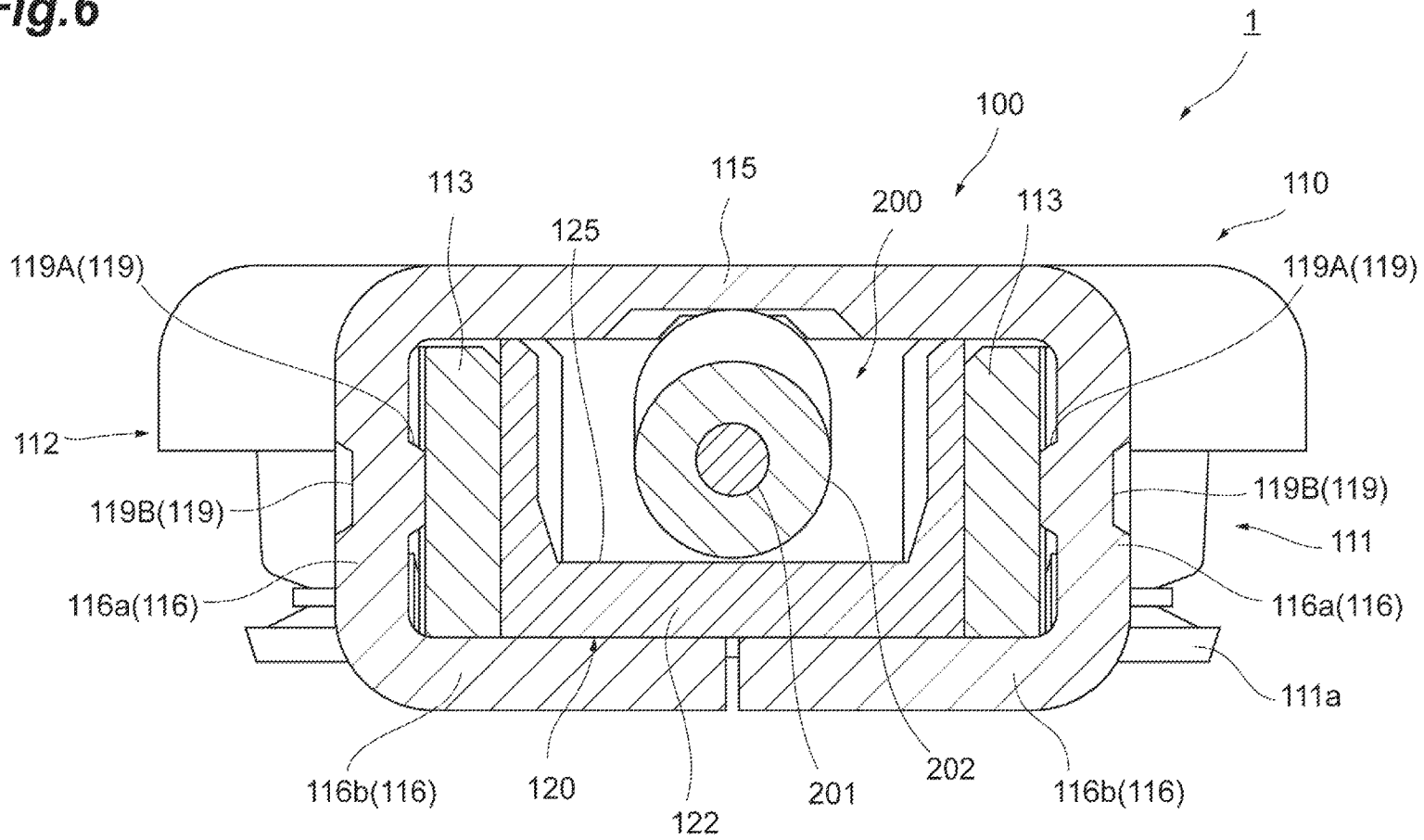
FIG. 6 is a cross-sectional view across the line VI-VI in FIG. 3.
Figure 7:
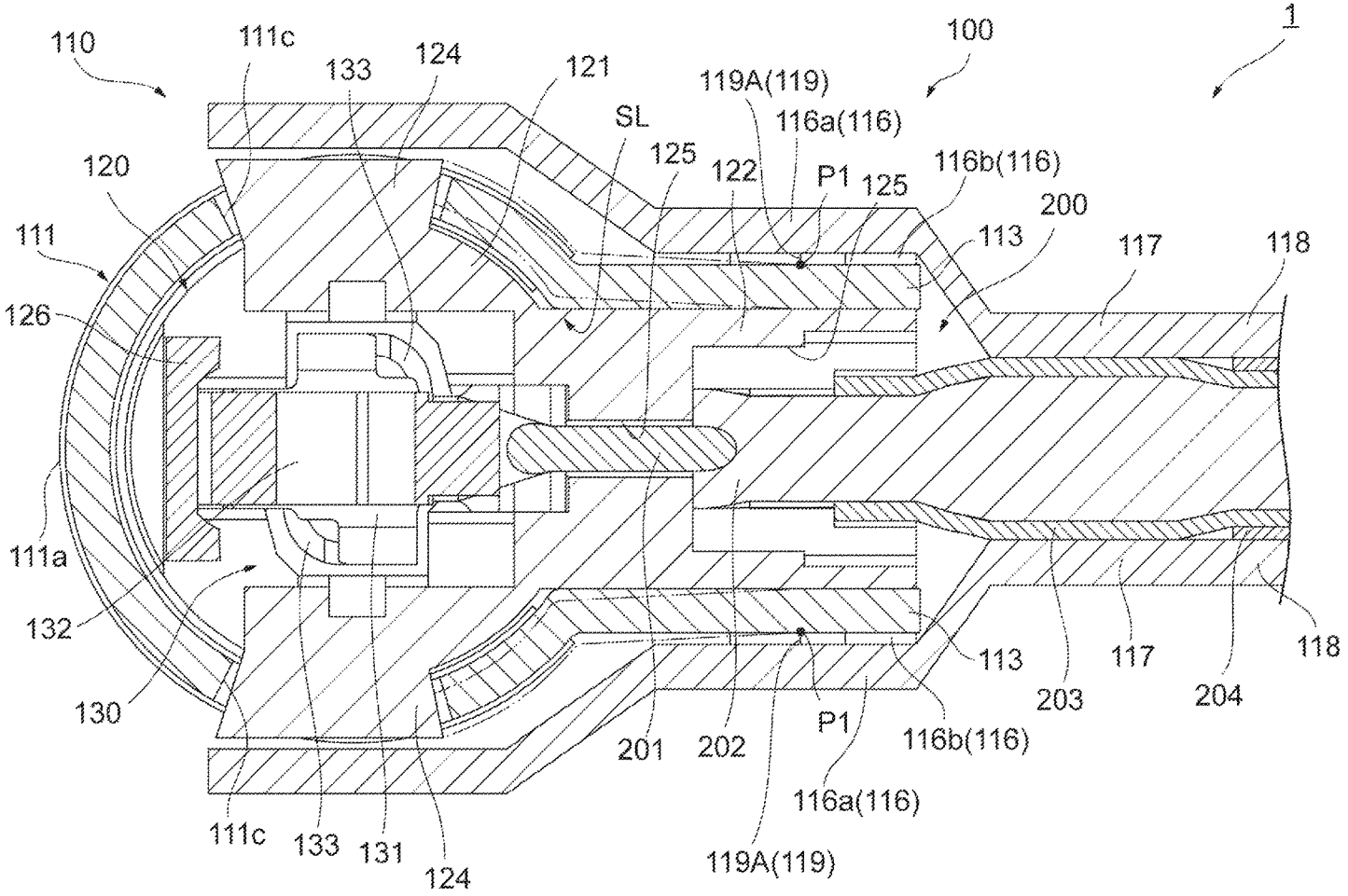
FIG. 7 is a cross-sectional view across the line VII-VII in FIG. 3.
Figure 8:
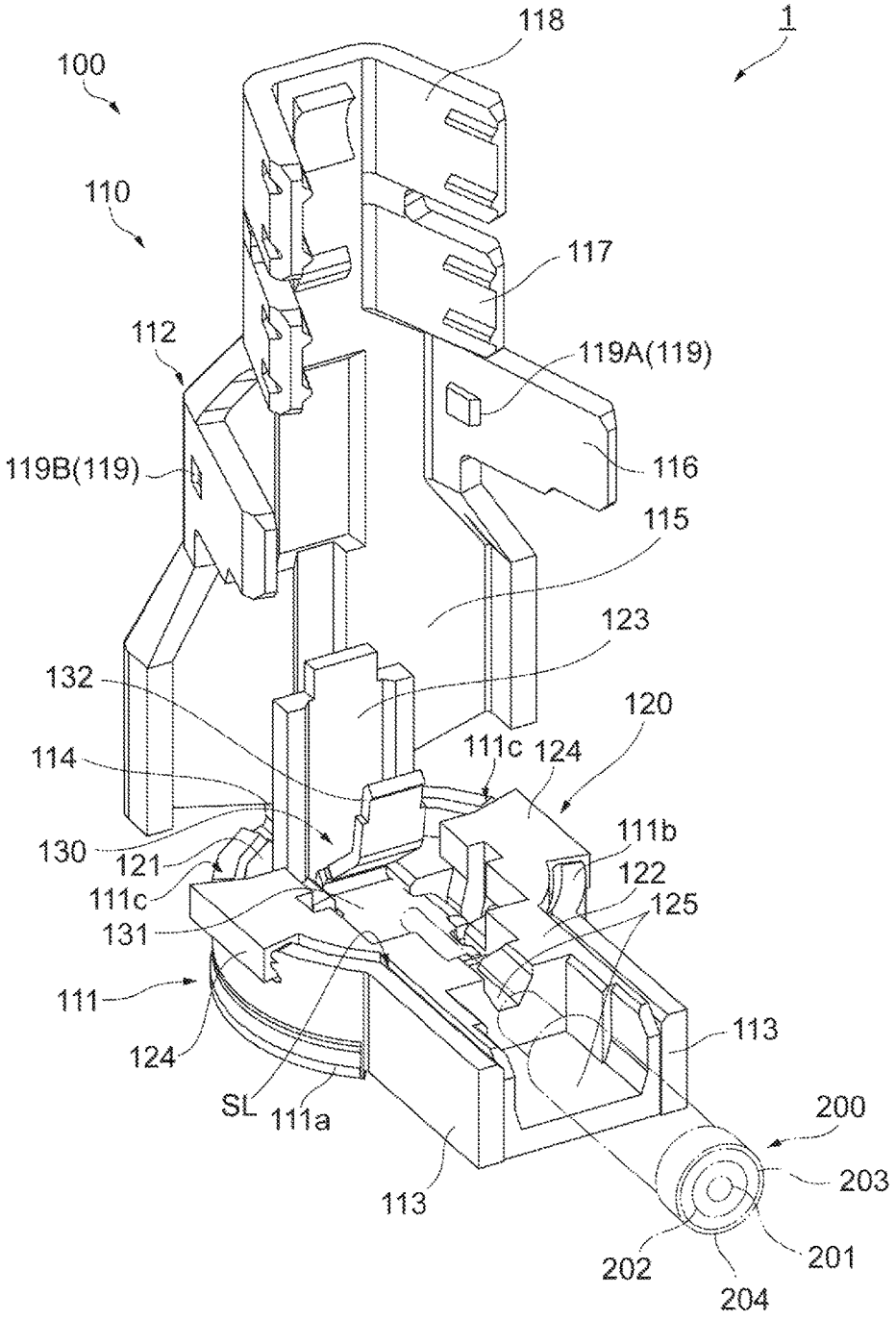
FIG. 8 is a perspective view of the plug connector in an open state.

When the coaxial cable 200 is connected to the plug connector 100, the coaxial cable 200 is processed. Specifically, as illustrated in FIGS. 5, 7 and 8, the external conductor 203, the insulator 202, and the internal conductor 201 are stripped stepwise in that order toward the tip of the coaxial cable 200.

[Ground Contact Conductor]

The ground contact conductor 110 is formed of a pressed metal sheet. Therefore, the ground contact conductor 110 is conductive. The ground contact conductor 110 includes a main body 111 and a lid 112.

The main body 111 is a cylindrical body. A slit SL extending in an extending direction (a cylinder-axis direction) of the main body 111 is formed on the peripheral surface of the main body 111 (see FIGS. 2, 4, and 7 to 10). In other words, the main body 111 has an arc shape when viewed in the cylinder-axis direction. The main body 111 is fittable to the receptacle connector to cover the outside of the receptacle connector. The main body 111 may also be fittable to the receptacle connector to be covered from the outside by the receptacle connector. When the main body 111 is fitted to the receptacle connector, a bottom edge 111*a* (an edge on a side that faces the circuit board in the main body 111) becomes elastically deformed.

As shown in FIGS. 2 to 4 and 7 to 10, arms 113 are integrally provided at side edges forming the slit SL in the main body 111. The arms 113 protrude from side edges forming the slit SL in the main body 111 in a radially outward direction of the main body 111 so that they extend in parallel to each another. A pair of notches 111*c* having a recessed shape are provided in an upper edge 111*b* of the main body 111 (the edge on the side in which a connecting portion 114 to be described below is positioned), as illustrated in FIGS. 7 to 10.

The lid 112 has a shell portion 115, and pairs of fixing portions 116 to 118, as illustrated in FIGS. 1 to 5. The shell portion 115 is connected to the main body 111 via a joint 114, as illustrated in FIGS. 1, 3, 5, 8, and 10. Therefore, the shell portion 115 (the lid 112) can be swung about the joint 114, and can approach or be separate from the main body 111 when the joint 114 is bent.

Figure 9:
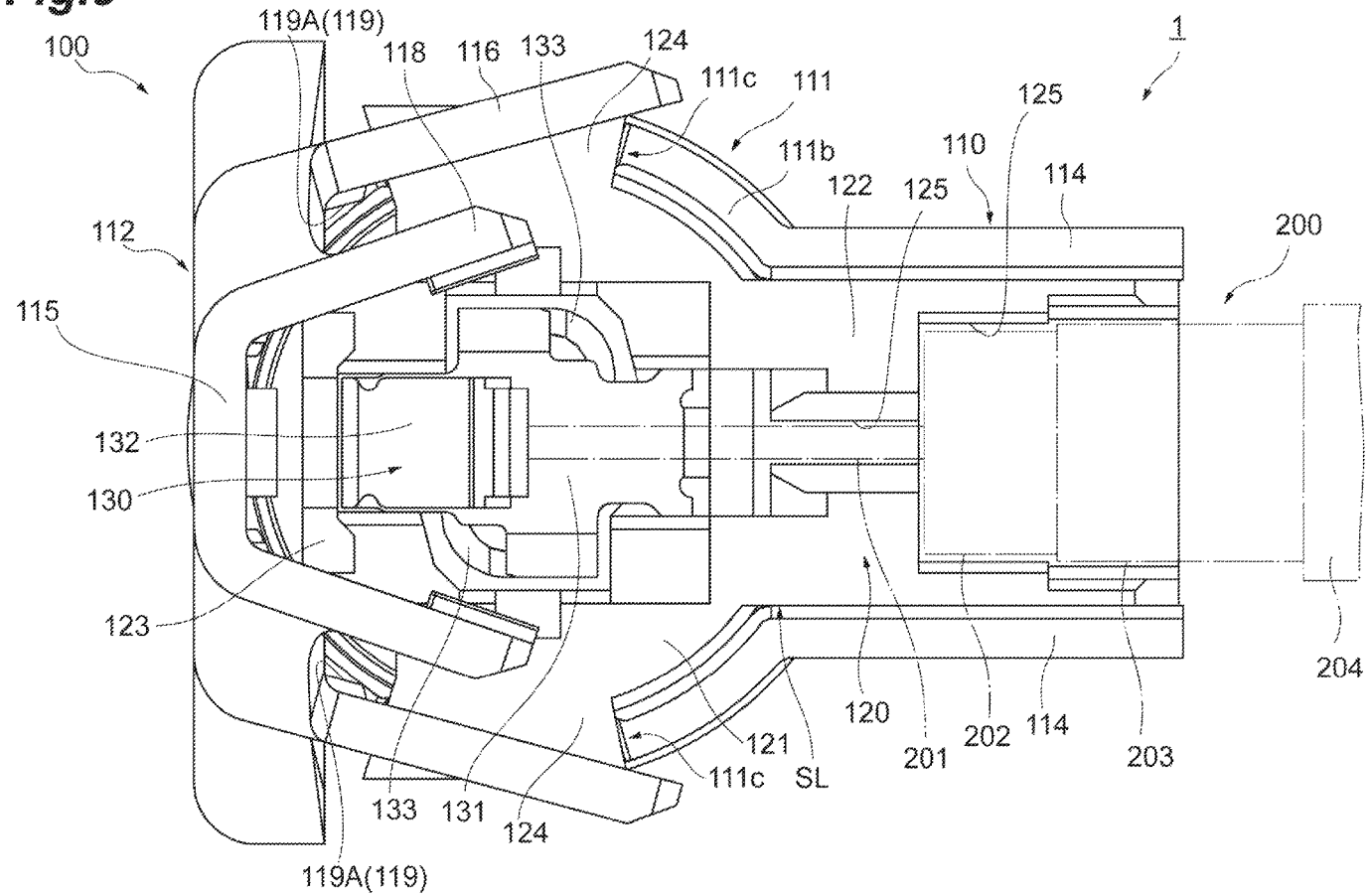
FIG. 9 is a plan view of the plug connector in an open state.
Figure 10:
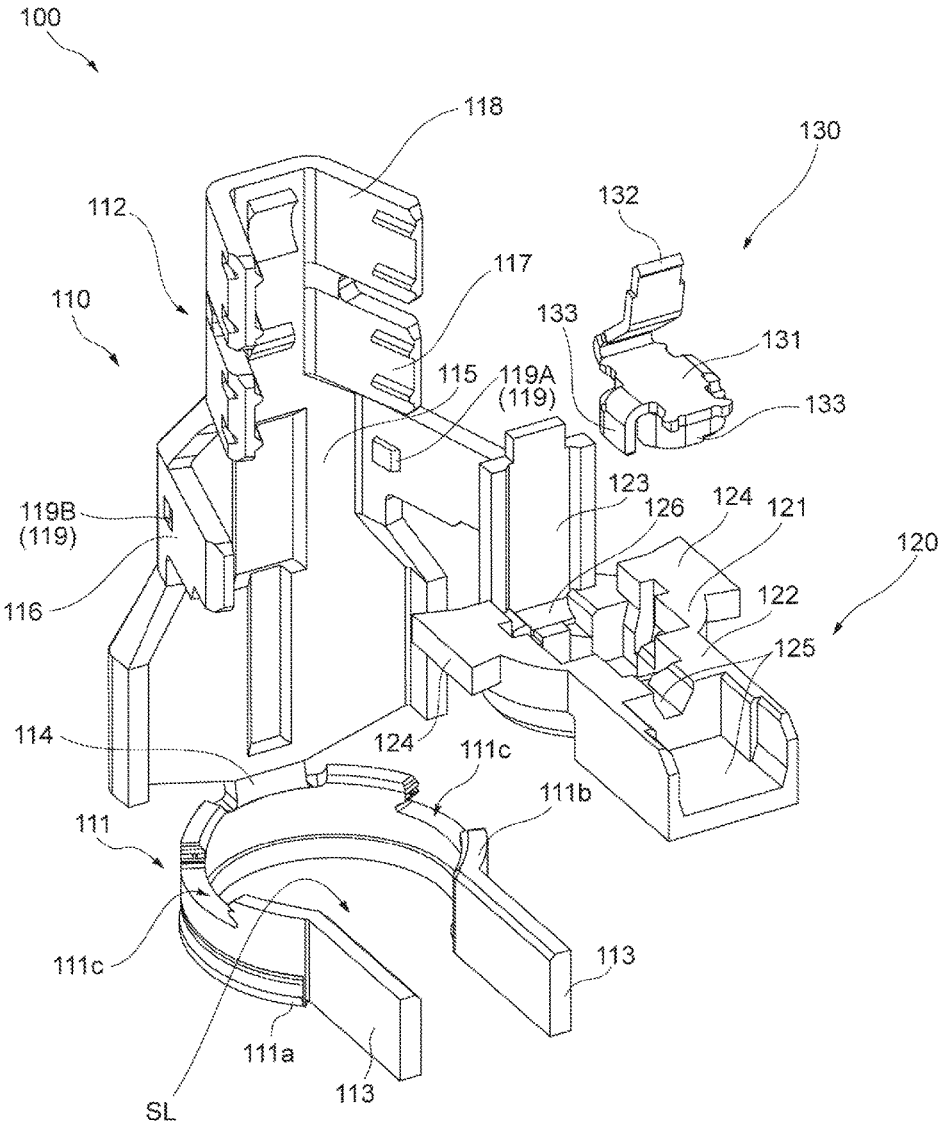
FIG. 10 is an exploded perspective view of the plug connector.

Before the coaxial cable 200 is attached to the plug connector 100, the joint 114 is not bent, and the lid 112 stands upright with respect to the main body 111 (in an upright standing state in which the lid is separated from the main body 111) as illustrated in FIGS. 8 to 10. On the other hand, when the lid 112 is folded down via the joint 114, the joint 114 becomes bent, and the lid 112 faces the main body 111 (a prone state in which the lid 112 approaches the main body 111) as illustrated in FIGS. 1 to 6. In the prone state of the lid 112, as illustrated in FIGS. 2 to 6, the shell portion 115 covers the main body 111 and the arms 113.

The pairs of fixing portions 116 to 118 is a plate-like body having a substantially rectangular shape. The pairs of fixing portions 116 to 118 are arranged in that order in a direction from the joint 114 side toward the side of the tip of the shell portion 115. The pairs of fixing portions 116 to 118 are cantilevered plate members. As illustrated in FIGS. 8 to 10, before the plug connector 100 is assembled, the pairs of fixing portions 116 to 118 extend laterally from both side edges of the shell portion 115 and stand upright with respect to the shell portion 115, and have a substantial L-shape.

Each of the fixing portions 116 includes a base end portion 116*a* integrally extending from the shell portion 115, and a tip portion 116*b* integrally extending from the base end portion 116*a*. As illustrated in FIGS. 2 to 4, 6, and 7, at a fixed state in which each of the fixing portions 116 is fixed to the corresponding arm 113 (the configuration at which the arms 113 are fastened with the fixing portions 116) (hereinafter simply referred to as a "fixed state"), the base end portion 116*a* faces a side surface of the corresponding arm 113. At the fixed state illustrated in FIGS. 2, 4 and 6, the tip portion 116*b* is bent inwardly at the base end portion 116*a*, and winds around the corresponding arm 113 up to a point at which the tip portion 116*b* reaches the edge of the arm 113 on the side facing the circuit board and a protrusion 122 provided to the insulating housing 120 (which will be described later in detail).

As illustrated in FIGS. 1 to 3, and 6 to 10, each of the base end portions 116*a* is provided with a contact portion 119. The contact portion 119 is not positioned at an edge of the base end portion 116*a* on the side of the main body 111. In other words, the contact portion 119 is positioned distantly from the edge of the base end portion 116*a* on the side of the main body 111 in the protruding direction of the pair of arms 113. Therefore, the contact portion 119 is in contact with the side surface of the corresponding arm 113 on the side more distant from the main body 111 than the edge of the base end portion 116*a* (on the side nearer to the tip of the arm 113 than the edge of the base end portion 116*a*).

The contact portion 119 may be positioned at the center of the width direction of the base end portion 116*a*. Alternatively, the contact portion 119 may be positioned nearer to the tip of the shell portion 115 than the center (near the fixing portions 117 and 118) in the base end portion 116*a*. In other words, in the fixed state, the contact portion 119 may be positioned at some distance from the center of the fixing portion 116 in the protruding direction (extending direction) of the pair of arms 113 extends. The contact portion 119 may be formed by pressing the base end portion 116*a*, for example.

The abutting portion 119 includes a protrusion 119A and a depression 119B. The protrusion 119A protrudes from the inner side surface of the base end portion 116*a* toward the outer side surface of the arm 113 in the fixed state, as illustrated in FIGS. 2 and 6 to 10. The protrusion 119A is in contact with the outer side surface of the arm 113 in the fixed state. Therefore, the area of the inner side surface of the base end portion 116*a*, other than the area of the protrusion 119A, is normally separated from the outer side surface of the arm 113. The height of the protrusion 119A (the length of the protrusion 119A protruding from the inner side surface of the base end portion 116*a*) may be set variously depending on conditions such as the size of the plug connector 100. For a small plug connector 100 with a height equal to or less than 1 millimeter with the plug connector 100 engaged with the receptacle connector, the height of the protrusion 119A may be 0.02 millimeter to 0.03 millimeter or so, for example. The depression 119B is depressed at a position corresponding to the protrusion 119A in the outer side surface of the base end portion 116*a*, as illustrated in FIGS. 1 to 3, 6, 8, and 10.

[Insulating Housing]

As illustrated in FIGS. 2 and 4 to 10, the insulating housing 120 is an insulator in which the signal contact conductor 130 is held and which insulates the ground contact conductor 110 from the signal contact conductor 130. The insulating housing 120 may be formed by injection-molding using, for example, a resin material. As illustrated in FIGS. 4 to 8, the insulating housing 120 has an insulating main body 121, a protrusion 122, and a pressing portion 123.

The insulating main body 121 has a cylindrical shape and can hold the signal contact conductor 130 therein. The outer diameter of the insulating main body 121 is set to be smaller than the inner diameter of the main body 111 of the ground contact conductor 110. Therefore, the insulating main body 121 is configured to be accommodatable in the main body 111 and a peripheral surface of the insulating main body 121 is covered with the main body 111.

As illustrated in FIGS. 7 to 10, a pair of engaging pieces 124 are integrally provided on the peripheral surface of the insulating main body 121. The pair of engaging pieces 124 is positioned at upper edges (edges on sides opposite to the circuit board in the insulating main body 121) of the insulating main body 121 in an extending direction (cylinder-axis direction) of the insulating main body 121. The pair of engaging pieces 124 protrudes from the external circumference surface of the insulating main body 121 in a radially outward direction. When the pair of engaging pieces 124 is engaged with the notch 111*c* of the main body 111, the insulating main body 121 is hooked onto the main body 111. Accordingly, the insulating main body 121 is held inside of the main body 111.

As illustrated in FIGS. 2, 4, 5, and 7 to 10, the protrusion 122 is provided integrally with the insulating main body 121 to protrude from the peripheral surface of the insulating main body 121 in a radially outward direction. The overall protrusion 122 has a rectangular parallelepiped shape and is disposed between the pair of arms 113. Therefore, a pair of outer side surfaces of the protrusion 122 is in contact with inner surfaces of the pair of arms 113, respectively.

As illustrated in FIGS. 5 to 10, a recessed groove 125 is formed on an upper surface (a surface on a side opposite to the circuit board in the protrusion 122) of the protrusion 122. The recessed groove 125 linearly extends in the extending direction of the protrusion 122 and communicates with the inside of the insulating main body 121. The inner size of the recessed groove 125 is increased stepwise in that order from the insulating main body 121 toward the tip of the protrusion 122. A part of the recessed groove 125 near the insulating main body 121 has a size that is approximately the same as the size of the internal conductor 201 of the coaxial cable 200, and holds the internal conductor 201 therein. A part of the recessed groove 125 near the tip of the protrusion 122 has a size that is approximately the same as the size of the insulator 202 and the external conductor 203 of the coaxial cable 200, and holds the insulator 202 and the external conductor 203 therein. Therefore, the protrusion 122 is configured to be able to support the internal conductor 201, the insulator 202, and the external conductor 203 of the coaxial cable 200.

As illustrated in FIGS. 5, and 7 to 10, the pressing portion 123 is integrally provided with the insulating main body 121 via a joint 126. Therefore, when the joint is bent, the pressing portion 123 swings about the joint 126 and is able to approach and be separated from the insulating main body 121. Before the coaxial cable 200 is attached to the plug connector 100, as illustrated in FIGS. 8 and 9, the pressing portion 123 stands upright with respect to the insulating main body 121 and the protrusion 122 (in an upright standing state in which the pressing portion 123 is separated from the insulating main body 121 and the protrusion 122). On the other hand, when the pressing portion 123 is folded via the joint 126, the joint 126 is bent, and the pressing portion 123 faces the insulating main body 121 and the protrusion 122 (a prone state in which the pressing portion 123 approaches the insulating main body 121 and the protrusion 122), as illustrated in FIG. 5. In the prone state of the pressing portion 123, the pressing portion 123 is covered with a part of the shell portion 115 near the joint 114, and faces the insulating main body 121 and a part of the protrusion 122 near the insulating main body 121.

[Signal Contact Conductor]

The signal contact conductor 130 is formed of a pressed metal sheet. Therefore, the signal contact conductor 130 is conductive. As illustrated in FIGS. 5 and 9, the signal contact conductor 130 includes a base piece 131, a clamping piece 132, and a pair of connecting pieces 133.

The base piece 131 is a rectangular plate-like body. The clamping piece 132 is a cantilevered plate member. The clamping piece 132 is integrally provided with an end of the base piece 131. The clamping piece 132 is positioned above the base piece 131. The clamping piece 132 has a bent portion that is bent to be protruded toward the base piece 131.

The pair of connecting pieces 133 are integrally provided with side edges of the base piece 131 and protrudes downwardly from the base piece 131. The pair of connecting pieces 133 is a cantilevered plate member having a substantial L-shape. The pair of connecting pieces 133 is fittable to the signal contact conductor of the receptacle connector. When the pair of connecting pieces 133 are fitted into the conductor contact of the receptacle connector, the pair of connecting pieces 133 is pushed and spread by the conductor contact and is elastically fitted to the conductor contact.

[Assembling Method]

A method of assembling the ground contact conductor 110, the insulating housing 120 and the signal contact conductor 130, and attaching the plug connector 100 to a tip of the coaxial cable 200 will now be described.

First, the coaxial cable 200 is processed. Specifically, the insulator 202, the external conductor 203, and the protection sheath 204 are removed so that the external conductor 203, the insulator 202, and the internal conductor 201 are stripped stepwise in that order toward the tip of the coaxial cable 200.

Next, as illustrated in FIGS. 8 to 10, the insulating housing 120 in which the pressing portion 123 is in the upright standing state is disposed in the main body 111 of the ground contact conductor 110 in which the lid 112 is in the upright standing state. In this case, the insulating housing 120 is assembled to the ground contact conductor 110 so that the protrusion 122 of the insulating housing 120 is positioned between the pair of arms 113, and the pair of engaging pieces 124 of the insulating housing 120 is engaged with the pair of respective notches 111*c* of the main body 111.

Next, the signal contact conductor 130 is placed in the insulating main body 121 of the insulating housing 120, as illustrated in FIGS. 8 to 10. In this case, the signal contact conductor 130 is supported by the insulating main body 121 while the connecting pieces 133 is inserted into the insulating main body 121.

Next, the internal conductor 201 of the processed coaxial cable 200 is disposed on the base piece 131 (refer to FIGS. 5 to 9). In this case, a part close to the insulator in the internal conductor 201 is accommodated in a part close to the insulating main body 121 in the recessed groove 125, and a part distant from the insulator 202 in the internal conductor 201 overlaps the base piece 131. The insulator 202 of the coaxial cable 200 and the tip portion of the external conductor 203 of the coaxial cable 200 are accommodated in a part close to the projection 122 in the recessed groove 125.

In this state, the lid 112 is pushed down toward the main body 111 until the lid 112 is in the prone state. In this case, the pressing portion 123 of the insulating housing 120 is pushed by the lid 112 and is pushed toward the insulating main body 121 until the pressing portion 123 is in the prone state. Through this process, the clamping piece 132 of the signal contact conductor 130 is pushed by the pressing portion 123 and the clamping piece 132 approaches the base piece 131. In this case, since a protruded bent portion of the clamping piece 132 is clamped by the pressing portion 123 and the internal conductor 201 of the coaxial cable 200, the entire clamping piece 132 is deformed into a flat shape. Therefore, as illustrated in FIGS. 5 and 7, the internal conductor 201 of the coaxial cable 200 is sandwiched between the clamping piece 132 and the base piece 131. As a result, the signal contact conductor 130 is electrically and physically connected to the internal conductor 201 of the coaxial cable 200, and a signal circuit is formed thereby.

Next, the pairs of fixing portions 116 are folded to the pair of arms 113 so that the pair of fixing portions 116 covers the pair of arms 113 from the outside and wind around a bottom surface (a surface on a side that faces the circuit board) of the protrusion 122. Through this process, the pair of fixing portions 116 grip the pair of arms 113 and the protrusion 122, and the lid 112 is fixed to the pair of arms 113 and the protrusion 122. In this case, the protrusions 119A of the pair of respective fixing portions 116 are in contact with corresponding arms 113, and the pair of arms 113 is in contact with the protrusion 122. Therefore, the protrusions 119A press the pair of arms 113 and the protrusion 122. The base end portions 116*a* and the arms 113 are separated from each other by the presence of the protrusions 119A.

Next, the pair of fixing portions 117 is folded so that the pair of fixing portions 117 covers a part (a part close to the protection sheath 204) of the external conductor 203 of the coaxial cable 200. Through this process, the external conductor 203 is fastened with the pair of fixing portions 117 from the exterior, and the pair of fixing portions 117 is fixed to the external conductor 203. In other words, the ground contact conductor 110 is electrically and physically connected to the external conductor 203 of the coaxial cable 200, and a ground circuit is formed thereby.

Next, the pair of fixing portions 118 is folded to the protection sheath 204 of the coaxial cable 200 so that the pair of fixing portions 118 cover the protection sheath 204. Through this process, the protection sheath 204 is fastened with the pair of fixing portions 118 from the exterior, and the pair of fixing portions 118 is fixed to the protection sheath 204.

Through the process described above, the coaxial cable 200 is held by the lid 112, and the plug connector 100 is attached to the coaxial cable 200. In this manner, the complete connector assembly 1 is achieved. In this case, the shell portion 115 covers a section of the coaxial cable 200 from the internal conductor 201 to the tip of the protection sheath 204. Then, when the plug connector 100 of the connector assembly 1 is fitted to the receptacle connector, the internal conductor 201 of the coaxial cable 200 is electrically connected to the signal circuit of the circuit board, and the external conductor 203 of the coaxial cable 200 is electrically connected to the ground circuit of the circuit board.

[Effects]

Figure 12:
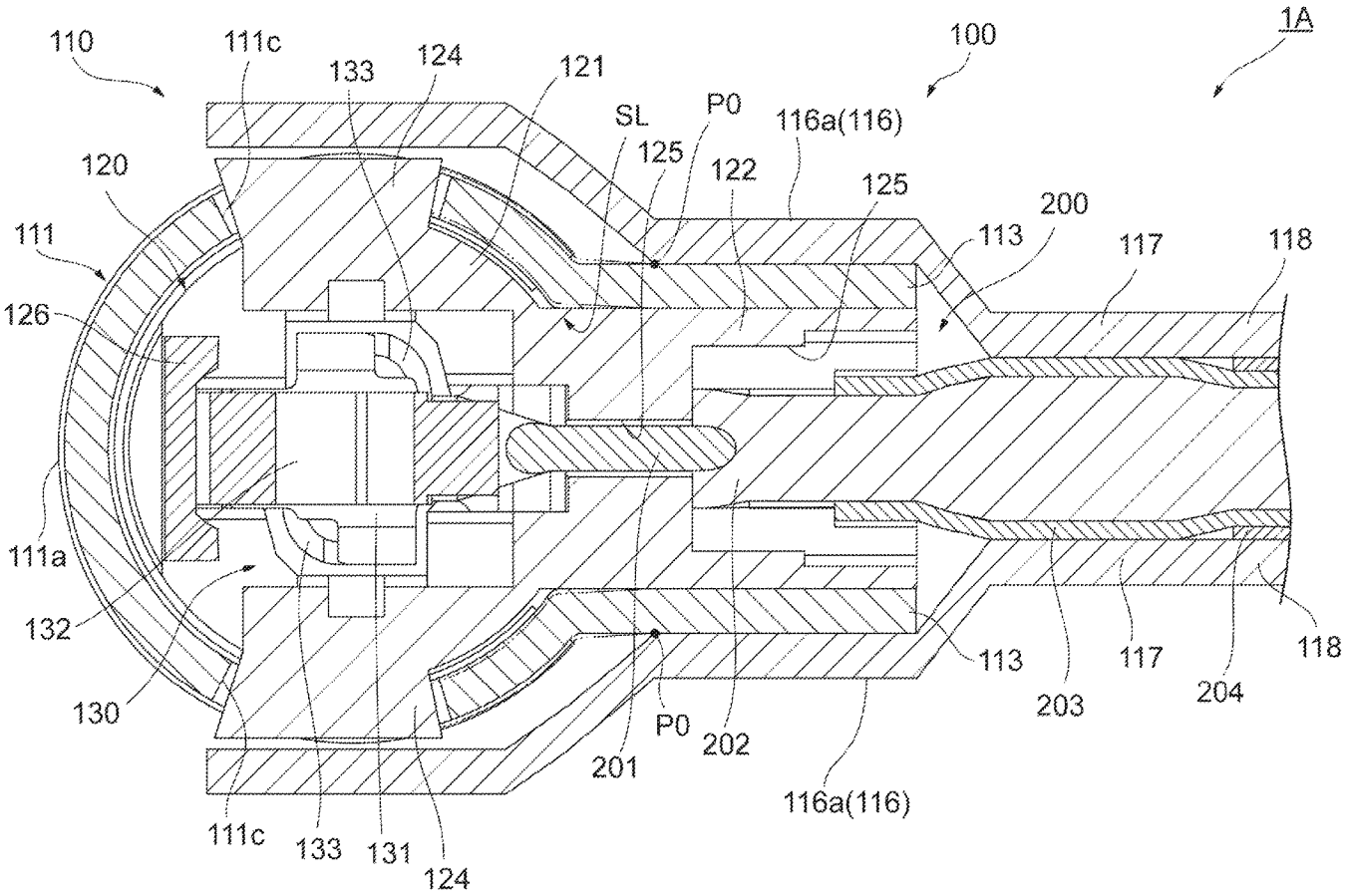
FIG. 12 is a cross-sectional view of a connector assembly according to a reference example in the same manner of FIG. 7.

A connector assembly 1A disclosed in Japanese Unexamined Patent Publication No. 2013-222685, as illustrated in FIG. 12, is different from the connector assembly 1 according to the embodiment in that none of the base end portions 116*a* have the contact portion 119, so that the base end portions 116*a* are in contact with the arms 113, and press the arms 113 and the protrusion 122 directly. In the connector assembly 1A, when the main body 111 of the ground contact conductor 110 is fitted to the receptacle connector and the diameter of the main body 111 is increased, the pair of arms 113 extending from the main body 111 also deforms in a direction separating from the protrusion 122. Specifically, because the arms 113 are in contact with the fixing portions 116 (the base end portions 116*a*) substantially entirely, a part closer to the main body 111 in the arms 113 than the fixing portion 116 becomes bent so that the part is separated from the protrusion 122 at a fulcrum at a position P0 illustrated in FIG. 12 (see the two-dot line in FIG. 12). In the connector assembly 1A, in order to ensure the fixing strength of the fixing portions 116, the fixing portions 116 are required to have some width. Therefore, the position P0 is positioned relatively near the main body 111. Thus, the bendable portions of the arms 113 are relatively small, so that it is not quite possible for the diameter of the main body 111 to increase sufficiently.

It is also possible to extend the length of the bendable portion of the pair of arms 113 by moving the pair of fixing portions 116 away from the main body, to ensure an appropriate level of inserting/removing resistance between the plug connector 100 and the receptacle connector. However, with such a configuration, the size of the overall plug connector 100 is increased. It is also possible to maintain the size of the plug connector 100 and to extend the length of the bendable portions of the pair of arms 113 by reducing the width of the pair of fixing portions 116 (the width of the fixing portions 116 in the direction in which the arms 113 extend), without changing the position of the fixing portions 116. However, when the width of the pair of fixing portions 116 is reduced, the rigidity of the pair of fixing portions 116 (the strength at which the pair of fixing portions 116 is fixed to the pair of arms 113) will be reduced, too. Therefore, when the plug connector 100 is to be removed from the receptacle connector by holding the lid 112, the pair of fixing portions 116 fixed to the pair of arms 113 may come loose.

Figure 11:
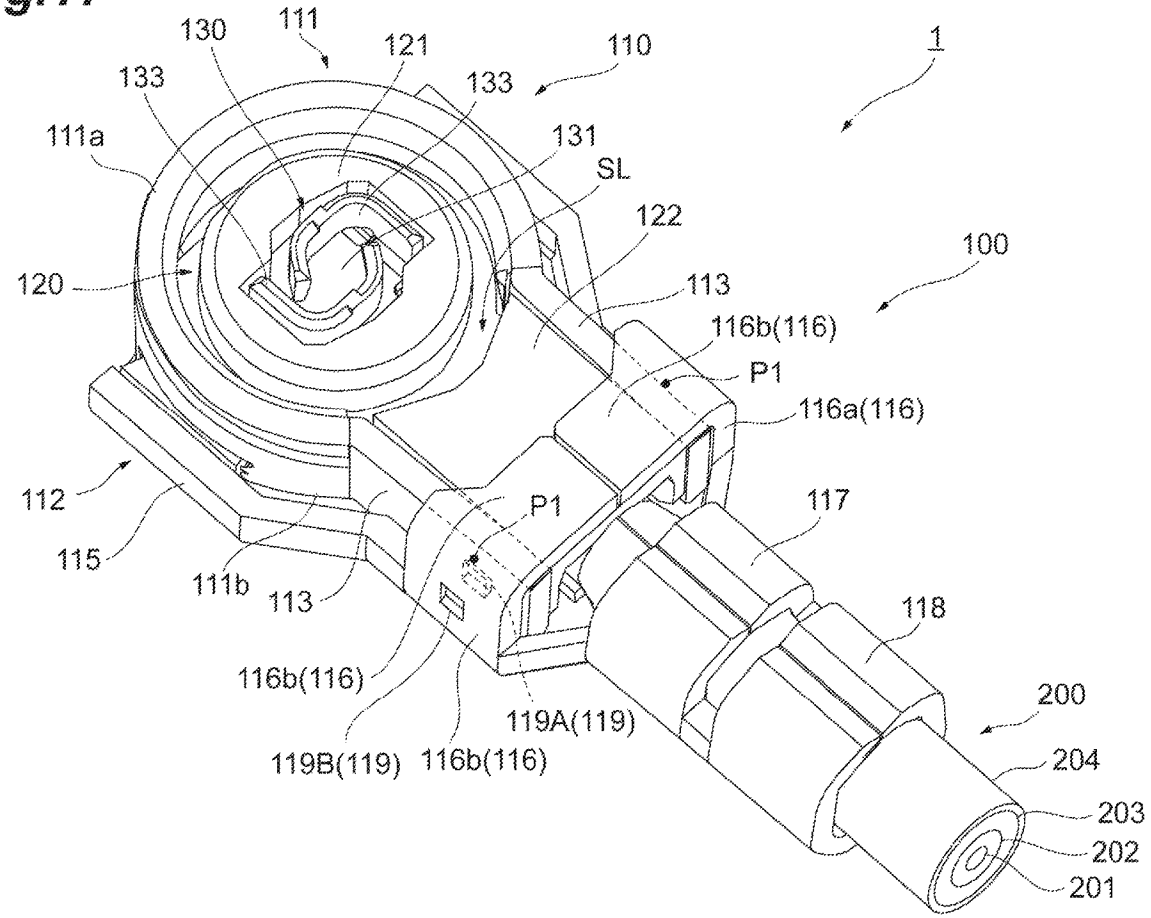
FIG. 11 is a perspective view of a ground contact conductor illustrated as deformed when viewed from the bottom side of the connector assembly.

By contrast, in the plug connector 100 according to the embodiment, each of the fixing portions 116 (the base end portion 116*a*) has the protrusion 119A, and the protrusion 119A protrudes toward the corresponding arm 113. In the state in which the arms 113 are fastened with the fixing portions 116 (fixed state), the protrusions 119A are in contact with the arms 113, and the arms 113 and the base end portions 116*a* are separated from each other by the presence of the protrusions 119A. Therefore, when the diameter of the main body 111 is increased in the fixed state, a part of the arm 113 on the side nearer to the main body 111 of the ground contact conductor 110 than the protrusion 119A becomes bent at the position P1 illustrated in FIGS. 7 and 11 (see the two-dot line in FIG. 7, and FIG. 11). Furthermore, in the plug connector 100 according to the embodiment, the protrusion 119A is positioned on the side distant from the edge close to the main body 111 in the fixing portion 116 in the protruding direction of the pair of arms 113. Therefore, compared with the connector assembly 1A, the length of the bendable portion of the arm 113 is increased. Thus, the arm 113 can serve more easily as an elastic body, so that a better inserting/removing resistance against the receptacle connector can be ensured without reducing the width of the fixing portions 116 (the base end portions 116*a*) or increasing the size of the plug connector 100. As a result, a better inserting/removing resistance against the receptacle connector can be achieved, while ensuring the rigidity and the size reduction.

In the plug connector 100 according to the embodiment, the protrusion 119A may be positioned at some distance from the center of the fixing portion 116 in the protruding direction of the pair of arms 113. In this case, the length of the deformable part of the arm 113 can be increased, so that the arms 113 can serve more easily as an elastic body. Therefore, an even better inserting/removing resistance against the receptacle connector can be achieved.

In the plug connector 100 according to the embodiment, the protrusion 122 of the insulating housing 120 is interposed between the pair of arms 113 and is in contact with the pair of arms 113. In other words, the pair of arms 113 is backed up by the protrusion 122. Therefore, when the pair of arms 113 as well as the protrusion 122 are fastened with the fixing portions 116, the force is applied more effectively on the pair of arms 113 via the protrusions 119 interposed between the fixing portions 116 and the pair of arms 113. Therefore, when the diameter of the main body 111 is increased, the pair of arms 113 is less displaced with respect to the protrusions 119A, so that a sufficient inserting/removing resistance can be ensured even when the plug connector 100 is inserted into and removed from the receptacle connector a number of times.

In the plug connector 100 according to the embodiment, the pair of fixing portions 116 provided to the lid 112 winds around the pair of arms 113 to a point reaching the edge of the arms 113 on the side facing the circuit board. Therefore, the fixing portion 116 can also serve to fix the lid 112 onto the arms 113, as well as to fasten the arms 113.

Other Embodiments

In the above description, an embodiment of the present disclosure is explained in detail, but various modifications of the embodiment are still possible within the scope and the essence of the present invention. For example, the present invention may be applied to other electrical connectors (a receptacle connector, for example).

Figure 13:
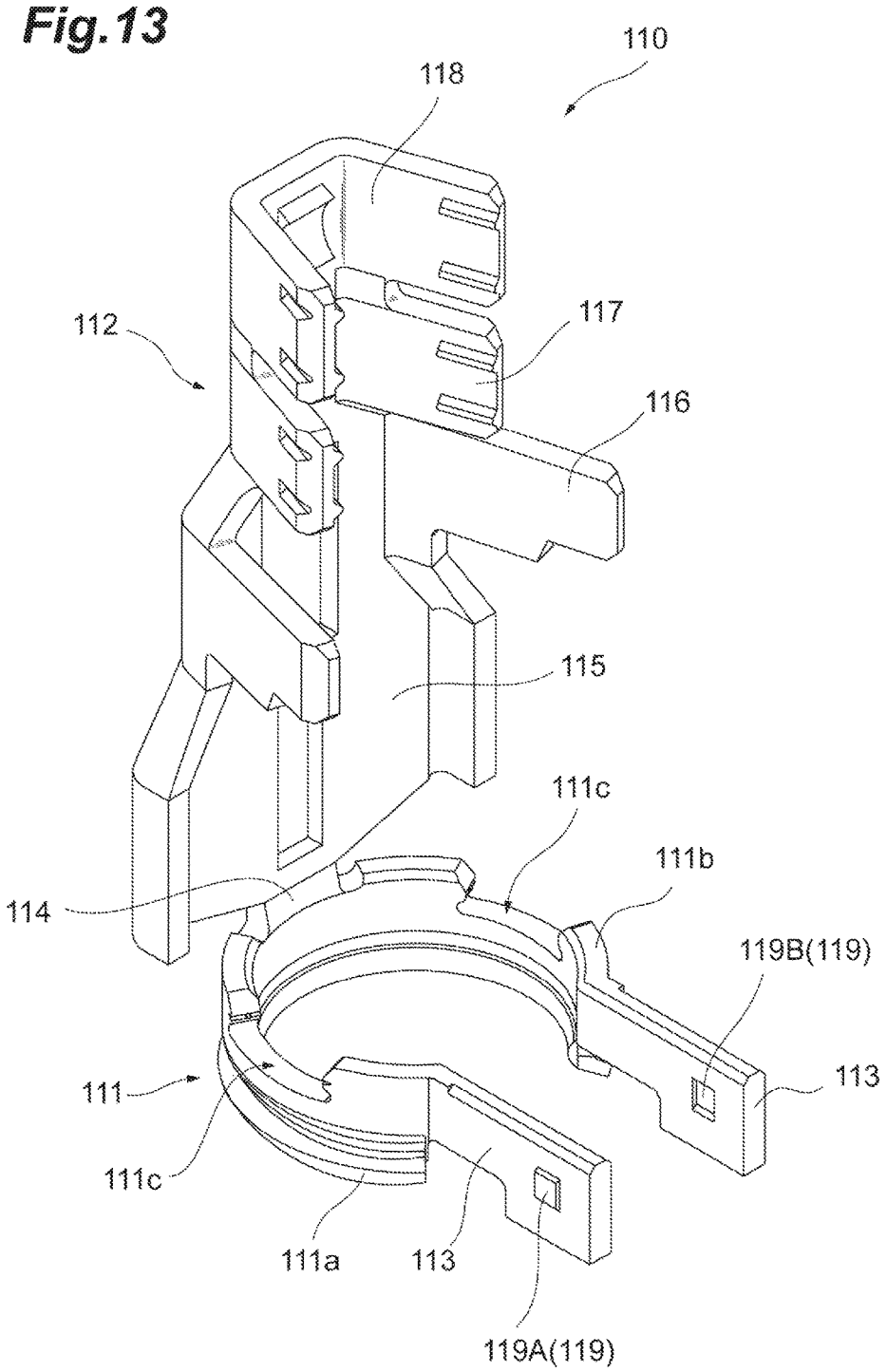
FIG. 13 is a perspective view of another example of the ground contact conductor in an open state.

As illustrated in FIG. 13, the contact portions 119 may be provided to the arms 113, instead of the fixing portions 116 (the base end portions 116*a*). In this case, the protrusion 119A protrudes from the arm 113 toward the inner side surface of the base end portion 116*a* in the fixed state. The protrusion 119A is in contact with the inner side surface of the base end portion 116*a* in the fixed state. Therefore, the area of the arm 113 other than the area of the protrusion 119A is normally separated from the inner side surface of the base end portion 116*a*. The depression 119B depresses at a position corresponding to the protrusion 119A on the inner side surface of the arm 113.

Indeed, the novel devices and methods described herein may be embodied in a variety of other forms; furthermore, various omissions, substitutions and changes in the form of the devices and methods described herein may be made without departing from the spirit of the inventions. The accompanying claims and their equivalents are intended to cover such forms or modification as would fall within the scope and spirit of the inventions.

Certain aspects, advantages, and novel features of the embodiment have been described herein. It is to be understood that not necessarily all such advantages may be achieved in accordance with any particular embodiment of the invention. Thus, the invention may be embodied or carried out in a manner that achieves or optimizes one advantage or group of advantages as taught herein without necessarily achieving other advantages as may be taught or suggested herein.

What is claimed is:

1. An electrical connector configured to be fittable to a counterpart connector mounted on a circuit board, the electrical connector comprising:

a conductive signal contact conductor to which an internal conductor of a coaxial cable is connected;

a ground conductive contact conductor to which an external conductor of the coaxial cable is connected; and an insulating housing that insulates the signal contact conductor from the ground contact conductor, wherein the ground contact conductor includes a cylindrical main body having a slit that extends in an extending direction thereof;

a pair of arms protruding from respective edges forming the slit of the main body in a radially outward direction of the main body; and a fixing portion configured to fasten around the pair of arms from the exterior, at least one of the pair of arms and the fixing portion has a protrusion protruding toward the other, the protrusion is positioned at a side on the fixing portion at a position that is distant from an end of the fixing portion, the end being near the main body, in a protruding direction of the pair of arms, and in a state in which the pair of arms is fastened with the fixing portion, the protrusion provided to at least one of the pair of arms and the fixing portion is in contact with the other, and the pair of arms and the fixing portion are separated from each other by the presence of the protrusion.

2. The electrical connector according to claim 1, wherein the protrusion provided to at least one of the pair of arms and the fixing portion is positioned on a side distant from the center of the fixing portion in the protruding direction of the pair of arms.

3. The electrical connector according to claim 1, wherein the insulating housing includes a cylindrical insulating main body configured to hold the signal contact conductor therein; and an insulating protrusion protruding in the radially outward direction of the insulating main body from the peripheral surface of the insulating main body, wherein the insulating protrusion is interposed between the pair of arms and is in contact with the pair of arms.

4. The electrical connector according to claim 2, wherein the insulating housing includes a cylindrical insulating main body configured to hold the signal contact conductor therein; and an insulating protrusion protruding in the radially outward direction of the insulating main body from the peripheral surface of the insulating main body, wherein the insulating protrusion is interposed between the pair of arms and is in contact with the pair of arms.

5. The electrical connector according to claim 1, wherein the ground contact conductor further includes a lid extending from an edge of the main body on a side distant from the circuit board, and the fixing portion is provided to the lid and winds around the pair of arms to a point reaching an edge of the arms on the side facing the circuit board.

6. The electrical connector according to claim 2, wherein the ground contact conductor further includes a lid extending from an edge of the main body on a side distant from the circuit board, and the fixing portion is provided to the lid and winds around the pair of arms to a point reaching an edge of the arms on the side facing the circuit board.

7. The electrical connector according to claim 3, wherein the ground contact conductor further includes a lid extending from an edge of the main body on a side distant from the circuit board, and the fixing portion is provided to the lid and winds around the pair of arms to a point reaching an edge of the arms on the side facing the circuit board.

8. The electrical connector according to claim 4, wherein the ground contact conductor further includes a lid extending from an edge of the main body on a side distant from the circuit board, and the fixing portion is provided to the lid and winds around the pair of arms to a point reaching an edge of the arms on the side facing the circuit board.

* * * * *